US009051680B1

(12) United States Patent
Harris

(10) Patent No.: US 9,051,680 B1
(45) Date of Patent: Jun. 9, 2015

(54) RETRACTABLE CLOTHESLINE SUPPORT AND METHOD

(71) Applicant: R. Darren Harris, Jonesville, NC (US)

(72) Inventor: R. Darren Harris, Jonesville, NC (US)

( * ) Notice: Subject to any disclaimer, the term of this patent is extended or adjusted under 35 U.S.C. 154(b) by 73 days.

(21) Appl. No.: 14/089,047

(22) Filed: Nov. 25, 2013

(51) Int. Cl.

| | |
|---|---|
| ***A47B 53/00*** | (2006.01) |
| ***D06F 53/04*** | (2006.01) |
| ***A47B 43/00*** | (2006.01) |
| ***D06F 57/04*** | (2006.01) |
| ***D06F 57/12*** | (2006.01) |
| *A47G 25/06* | (2006.01) |

(52) U.S. Cl.
CPC ..... *D06F 53/045* (2013.01); *A47G 25/0685* (2013.01); *A47B 43/00* (2013.01); *D06F 57/04* (2013.01); *D06F 57/12* (2013.01)

(58) Field of Classification Search
CPC ..... D06F 57/04; D06F 57/12; D06F 53/045; A47G 25/0685; A47B 43/00
USPC ..... 211/1.3, 96, 195, 172, 97–102, 119.01, 211/85.3; 224/313, 314, 326, 493, 162; 108/28, 29, 160, 152, 134, 135; 43/18.1 CT, 15, 16; 248/240, 240.4, 248/289.11, 353
See application file for complete search history.

(56) References Cited

U.S. PATENT DOCUMENTS

| | | | | | |
|---|---|---|---|---|---|
| 72,057 | A | * | 12/1867 | Lyman | 211/1.3 |
| 93,999 | A | * | 8/1869 | Johnson | 211/104 |
| 257,631 | A | * | 5/1882 | Abbey | 211/101 |
| 303,695 | A | * | 8/1884 | Bisel | 211/98 |
| 334,559 | A | * | 1/1886 | Bogel | 211/98 |
| 493,880 | A | * | 3/1893 | Tyler | 211/98 |
| 545,658 | A | * | 9/1895 | Prescott | 211/97 |
| 604,437 | A | * | 5/1898 | Tarbox | 211/1.3 |
| 751,265 | A | * | 2/1904 | Crossley | 211/119.01 |
| 777,185 | A | * | 12/1904 | Coyner | 211/1.3 |
| 806,401 | A | * | 12/1905 | Dawson | 211/119.01 |
| 895,905 | A | * | 8/1908 | Soraghan | 211/99 |
| 975,273 | A | * | 11/1910 | Noppe | 211/97 |
| 975,575 | A | * | 11/1910 | Sorroggie | 211/95 |
| 1,008,013 | A | * | 11/1911 | Connolley | 211/99 |
| 1,156,286 | A | * | 10/1915 | Harbin | 211/165 |
| 1,269,012 | A | * | 6/1918 | Singleterry | 211/98 |
| 1,318,257 | A | * | 10/1919 | Blaustein | 211/99 |
| 1,373,460 | A | * | 4/1921 | Striker et al. | 211/99 |
| 1,382,709 | A | * | 6/1921 | Zalevski et al. | 211/85.3 |
| 1,493,436 | A | * | 5/1924 | Kubista et al. | 242/388.6 |
| 1,497,280 | A | * | 6/1924 | Kilfoyle | 254/417 |
| 1,535,222 | A | * | 4/1925 | Harrison | 211/97 |
| 1,582,762 | A | * | 4/1926 | Klock | 211/99 |
| 1,587,674 | A | * | 6/1926 | Patterson | 211/1.3 |
| 1,587,676 | A | * | 6/1926 | Patterson | 211/1.3 |
| 1,648,636 | A | * | 11/1927 | Burdick | 211/102 |

(Continued)

OTHER PUBLICATIONS

Twenty-seven (27) pictures showing various clothesline devices used with RV's taken by applicant during a 2010 camping trip.

*Primary Examiner* — Joshua J Michener
*Assistant Examiner* — Devin Barnett
(74) *Attorney, Agent, or Firm* — Blake P. Hurt

(57) ABSTRACT

A retractable clothesline support and method utilizes a pivotable arm hingedly attached to a housing. The arm having a reel with a line such as a clothesline wound thereon can be unlocked and then unreeled. The line support is particularly useful with an RV or other mobile vehicle while traveling for hanging wet clothes or the like for drying purposes. When not in use the clothesline can be wound on the reel, the reel locked and the arm closed for containment within the housing.

18 Claims, 7 Drawing Sheets

(56) References Cited

U.S. PATENT DOCUMENTS

| | | | | | |
|---|---|---|---|---|---|
| 1,705,203 | A | * | 3/1929 | Patterson | 211/1.3 |
| 1,722,191 | A | * | 7/1929 | Binkele | 211/98 |
| 1,724,218 | A | * | 8/1929 | Nixon | 211/1.3 |
| 1,740,653 | A | * | 12/1929 | Hunneman | 211/104 |
| 1,836,008 | A | * | 12/1931 | Anzalone | 211/94.03 |
| 1,950,745 | A | * | 3/1934 | Patterson | 242/395.1 |
| 2,061,499 | A | * | 11/1936 | Bode | 211/1.3 |
| 2,434,891 | A | * | 1/1948 | Swanson | 211/97 |
| 2,451,114 | A | * | 10/1948 | Peterson | 211/104 |
| 2,476,772 | A | * | 7/1949 | Sarac | 242/379 |
| 2,498,518 | A | * | 2/1950 | Zingman et al. | 211/95 |
| 2,754,010 | A | * | 7/1956 | Griffith | 211/97 |
| 2,778,705 | A | * | 1/1957 | Barker | 312/313 |
| 2,812,068 | A | * | 11/1957 | Lord | 211/100 |
| 2,938,514 | A | * | 5/1960 | Berg | 124/88 |
| 3,249,233 | A | * | 5/1966 | Marcus et al. | 211/105.3 |
| 3,285,423 | A | * | 11/1966 | Bar-Giora | 211/1.3 |
| 3,335,872 | A | * | 8/1967 | Dodich | 211/85.3 |
| 3,363,777 | A | * | 1/1968 | Cooper | 211/85.3 |
| 3,417,874 | A | * | 12/1968 | Bryant | 211/100 |
| 3,897,122 | A | * | 7/1975 | McEvers | 312/321 |
| 3,941,250 | A | * | 3/1976 | Ott | 211/1.3 |
| 4,031,651 | A | * | 6/1977 | Titze | 43/15 |
| 4,051,953 | A | * | 10/1977 | Shoaf | 211/119.1 |
| 4,171,748 | A | * | 10/1979 | Fabian | 211/1.3 |
| 4,190,233 | A | * | 2/1980 | Godfrey | 254/4 B |
| 4,225,048 | A | | 9/1980 | Hildreth | 211/1.3 |
| D259,228 | S | * | 5/1981 | Fabian | D6/324 |
| 4,434,897 | A | * | 3/1984 | Gelhaus | 211/1.3 |
| 4,470,558 | A | | 9/1984 | Stamper | 242/107.15 |
| 4,620,635 | A | * | 11/1986 | Morand | 211/47 |
| 4,632,255 | A | * | 12/1986 | Kennedy | 211/1.3 |
| 4,771,895 | A | * | 9/1988 | Steiner | 211/1.3 |
| 4,773,179 | A | * | 9/1988 | Corley | 43/19 |
| 4,856,661 | A | | 8/1989 | Guillen et al. | 211/100 |
| 5,090,578 | A | | 2/1992 | Arnold | 211/119 |
| D324,784 | S | * | 3/1992 | Rose | D6/324 |
| 5,240,128 | A | * | 8/1993 | Ohm | 211/197 |
| 5,363,975 | A | * | 11/1994 | Meade | 211/197 |
| D359,379 | S | * | 6/1995 | Haviland | D26/140 |
| 5,566,843 | A | * | 10/1996 | Kruska | 211/104 |
| 6,257,418 | B1 | * | 7/2001 | Allen et al. | 211/1.3 |
| 6,464,091 | B1 | * | 10/2002 | Nagasaki | 211/104 |
| 7,234,603 | B1 | * | 6/2007 | Harris et al. | 211/100 |
| 7,273,154 | B1 | | 9/2007 | Edwards | 211/119.01 |
| D615,770 | S | * | 5/2010 | Meltzer | D6/441 |
| 7,717,391 | B2 | | 5/2010 | Roberts | 248/353 |
| 7,806,280 | B1 | * | 10/2010 | Perkins et al. | 211/100 |
| 8,573,417 | B1 | * | 11/2013 | Anderson | 211/119.01 |
| 2008/0277358 | A1 | * | 11/2008 | Meltzer | 211/1.3 |
| 2009/0084744 | A1 | * | 4/2009 | Meltzer | 211/105 |
| 2009/0242500 | A1 | * | 10/2009 | Li | 211/116 |
| 2013/0186846 | A1 | * | 7/2013 | Raghunathan et al. | 211/119.01 |

* cited by examiner

RETRACTABLE CLOTHESLINE SUPPORT AND METHOD

FIELD OF THE INVENTION

The invention herein pertains to a line support having a lockable reel and particularly pertains to a retractable clothesline support for attachment to an RV, trailer, camper or other mobile vehicles.

DESCRIPTION OF THE PRIOR ART AND OBJECTIVES OF THE INVENTION

While camping in an RV, trailer, motor home or the like it is often difficult to suspend a line such as for example a clothes line in a convenient manner. Various clothes, hoses/equipment, and the like need drying to prevent mold, mildew and the like. Certain types of old hangers and retractable clothesline supports are shown for example in U.S. Pat. Nos. 4,225,048; 4,470,558; 4,856,661; 5,090,578; 7,273,154; and 7,717,391.

However, such prior art devices do not solve many of the problems encountered during parking in an RV or camper and therefore the present invention was conceived and one of its objectives is to provide a retractable clothesline support which can be easily affixed and permanently installed on the outside of an RV or similar vehicle for use at a campsite or other location.

It is another objective of the present invention to provide a retractable clothesline support and method for use which securely protects the clothesline during travel yet can be quickly opened and the clothesline extended upon arrival at a campground or other location for hanging or drying various items.

It is still another objective of the present invention to provide a clothesline support which allows the user to select any of a number of line lengths and configurations for easy placement and drying of wet clothes, equipment parts or the like.

It is yet another objective of the present invention to provide a retractable clothesline support which has relatively few components and is inexpensive to manufacture and sell.

It is a further objective of the present invention to provide a clothesline support which can be latched into a closed position for compact storage and which contains a line reel which can be locked or unlocked as needed during use.

Various other objectives and advantages of the present invention will become apparent to those skilled in the art as a more detailed description is set forth below.

SUMMARY OF THE INVENTION

The aforesaid and other objectives are realized by providing a retractable clothesline support for use with a clothesline or the like and includes a lockable reel which maintains the line during use. The line support has an arm hingedly attached to a housing whereby the arm can be released and extended substantially in a ninety degree angle from the housing through a hinge. A line reel is affixed to the arm and can be locked into place and released when needed. A telescoping arm extension is affixed atop the arm for extending the usable length of the arm. The arm extension includes a line guide for attachment of the clothesline thereto as needed.

In order to maintain the arm in its open, generally horizontal posture, a pneumatic cylinder urges the arm from the housing whereby a retractable brace can then be adjusted using a tightenable thumb screw to maintain the arm in the open posture. The telescoping arm can be extended as desired and once the arm is suitably extended, the reel can be manually unlocked and the line thereon urged therefrom for attachment to the side of the RV, a tree, a post or other desired structure, or alternatively back through the line guide on the arm extension, forming one of many suitable clothesline configurations. Thereafter the reel is locked to maintain the selected line configuration. In the method of use, the reel can be unlocked and the line can be quickly retracted onto the reel, the arm closed to the housing and latched, protecting the line and the other components from dirt and debris as may be encountered during travel.

DETAILED DESCRIPTION OF THE PREFERRED EMBODIMENT AND OPERATION OF THE INVENTION

Figure 1:
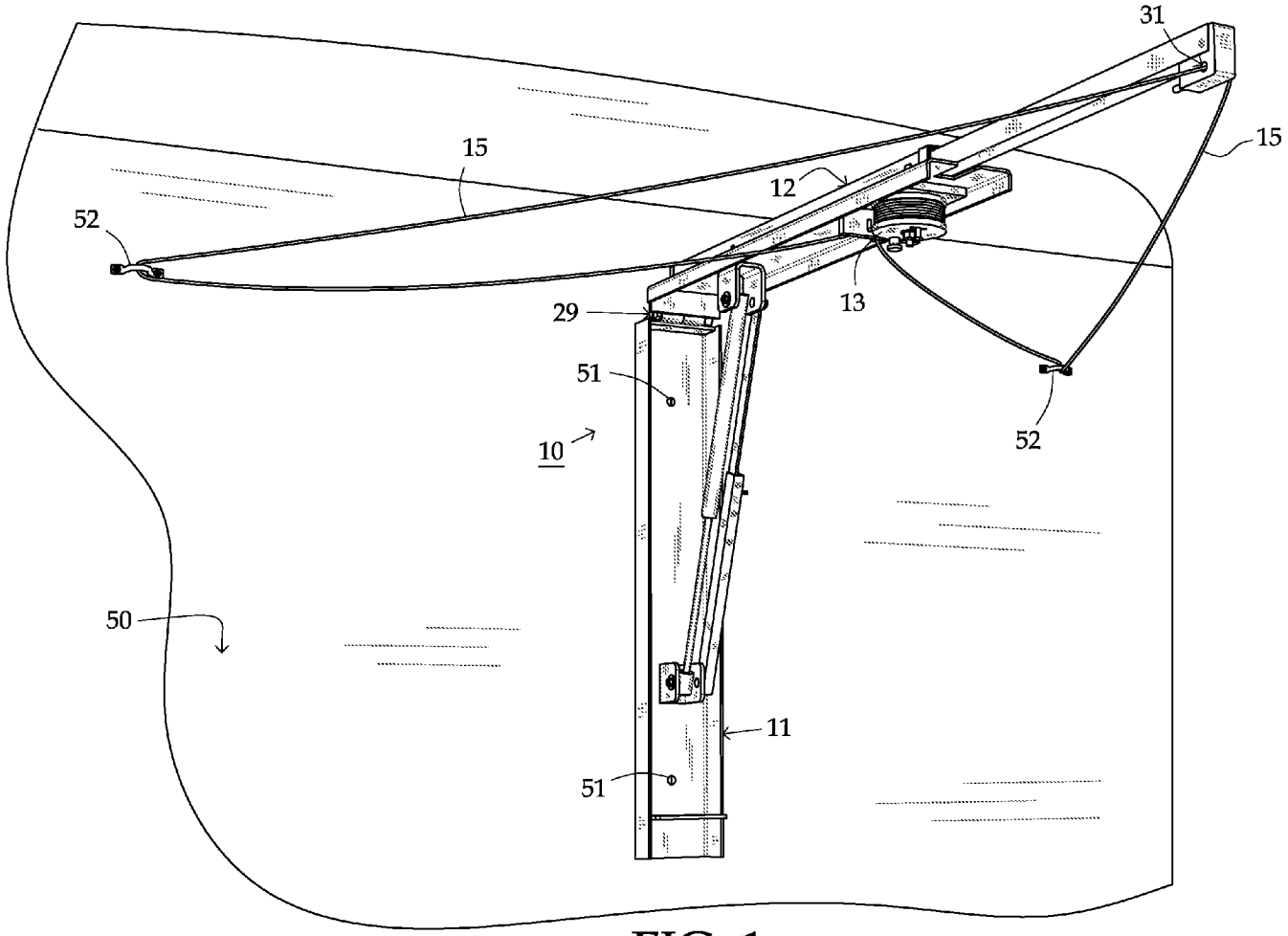
FIG. 1 shows a perspective view of the retractable clothesline support mounted on the side of an RV (shown in fragmented fashion) in an open configuration with the clothesline extended and ready for use.

For a better understanding of the invention and its operation, turning now to the drawings, FIG. 1 illustrates preferred retractable clothesline support 10 attached to the partial side of conventional RV 50 by conventional fasteners such as screws 51, bolts or the like. Clothesline support 10 could likewise be used while attached to the side of a post, house, camper or other suitable structure as desired. Clothesline support 10 is shown fully opened with a typical line such as a nylon clothesline 15 extended for use and attached to RV 50 such as by marine grade stainless steel padeyes 52 which can be mounted horizontally as shown, vertically or diagonally as desired. Clothesline 15 is preferably a marine grade nylon line which is stronger, more durable and resistant to abrasions, rot/mildew and can be stored either wet or dry. Clothesline 15 comprises a length preferably of thirty feet (30') however could be of any length.

Figure 2:
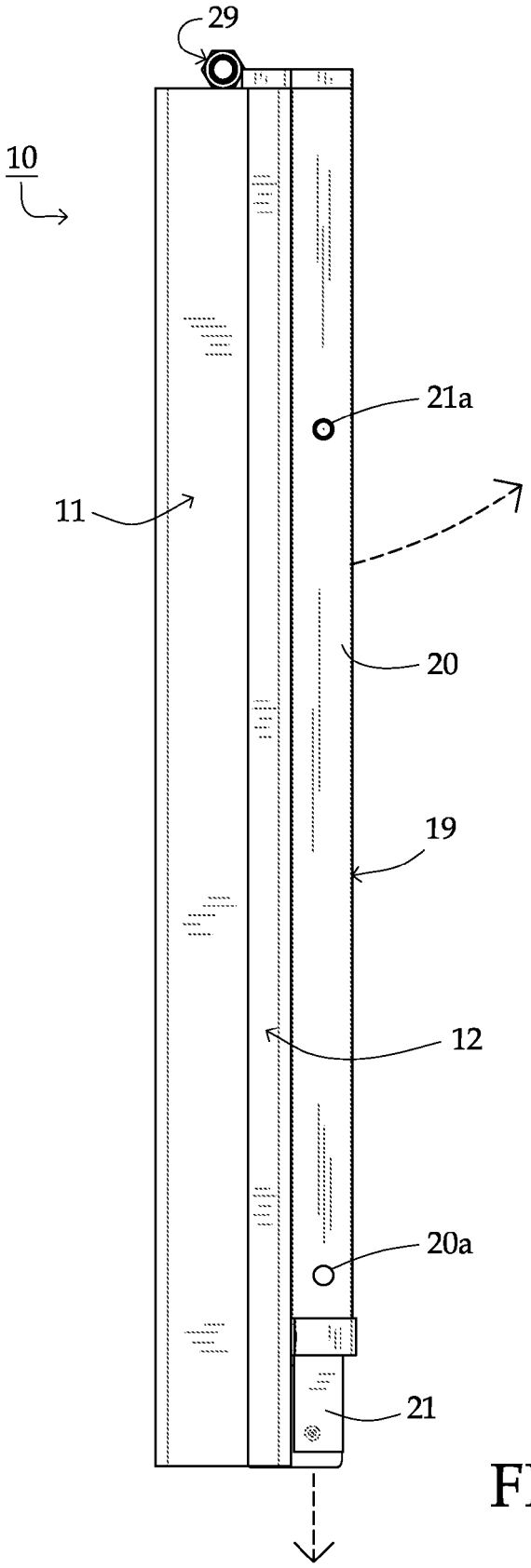
FIG. 2 pictures a left side elevational view of the clothesline support as removed from the RV in a closed configuration, the right side elevational view being a mirror image thereof.

Clothesline support 10 includes main housing 11 and pivotable arm 12 attached thereto by hinge 29 as also seen in FIG. 2. Rectangular housing 11 comprises a U-shaped cross-section or channel and includes end member 24 (FIGS. 1, 3 and 5) which extends from one side to the other of the channel and includes aperture 23 formed therein. Pivotable arm 12 likewise comprises a U-shaped cross-section and includes reel 13 with line 15 and line guide 30 attached to the inside thereof as shown enlarged and exploded in FIG. 4. Reel 13 is rotatably affixed to arm 12 such as by axle 44 having a threaded end for attachment of conventional washer 45 and nut 46 to maintain reel 13 thereon. Reel 13 further includes reel winder 41 and reel lock 26. The opposing end of reel axle 44 is rigidly affixed within plate 42 having a series of apertures 43 therearound for reception of the opposing end 26*e* of reel lock 26 to thus lock reel 13 in place to prevent unwanted movement. Reel lock 26 further includes knobbed end 26*a* joined to main, cylindrical body 26*b*, and cross member 26*c* which is received within recess 27 of reel 13. As would be understood when reel lock 26 is disengaged reel 13 is free to rotate around axle 44 for winding and unwinding of line 15, when locking of reel 13 is desired reel lock 26 is manually rotated and engaged whereby end 26*e* seats within one of apertures 43. Line guide 30, similar to end member 24, spans from one side of U-shaped arm 12 to the other and is, formed from polycarbonate plastic and attached to arm 12 such as by screws, adhesives or other suitable attachment means. Line guide 30 includes circular line guide catch 30*a* and a pair of openings 30*b* formed therein.

Clothesline support 10 further includes pneumatic cylinder 16 and adjustable, retractable brace 17 which are both affixed at one end to housing 11 and at the opposing end to pivotable arm 12 (see FIG. 1). As would be understood when support 10 is collapsed as shown in FIG. 2, the respective sides of pivotable arm 12 abut respective sides of housing 11 such that reel 13 is maintained between end member 24 and line guide 30 whereby pneumatic cylinder 16 and retractable brace 17 are separated from reel 13 by line guide 30. Such closure and separation prevents dust, debris and the like from entering clothesline support 10 and maintains reel 13 in a confined space prohibiting unwinding or tangling of clothesline 15 with pneumatic cylinder 16 and retractable brace 17.

Clothesline 15 is wound on reel 13 as conventional and includes toggle 15*a* at the end thereof which is positionable through for example one of openings 30*b* in line guide 30 (FIG. 4) and acts as a fastener preventing inadvertent removal. As would be understood, toggle 15*a* can be aligned in parallel with line 15 and manipulated to pass through an opening such as openings 30*b* in line guide 30, line guide 31, padeyes 52 or otherwise and then released to return to its relaxed, perpendicular orientation with line 15. As seen for example in FIG. 1, line 15 with toggle 15*a* has been extended and passed through one of openings 30*b* in line guide 30 (FIG. 4), one of padeyes 52 on RV 50, line guide 31 on arm extension 19 (FIG. 4), the second or opposing padeye 52 and affixed within line guide catch 30*a* (FIG. 4) which comprises a conventional eye hook.

Figure 3:
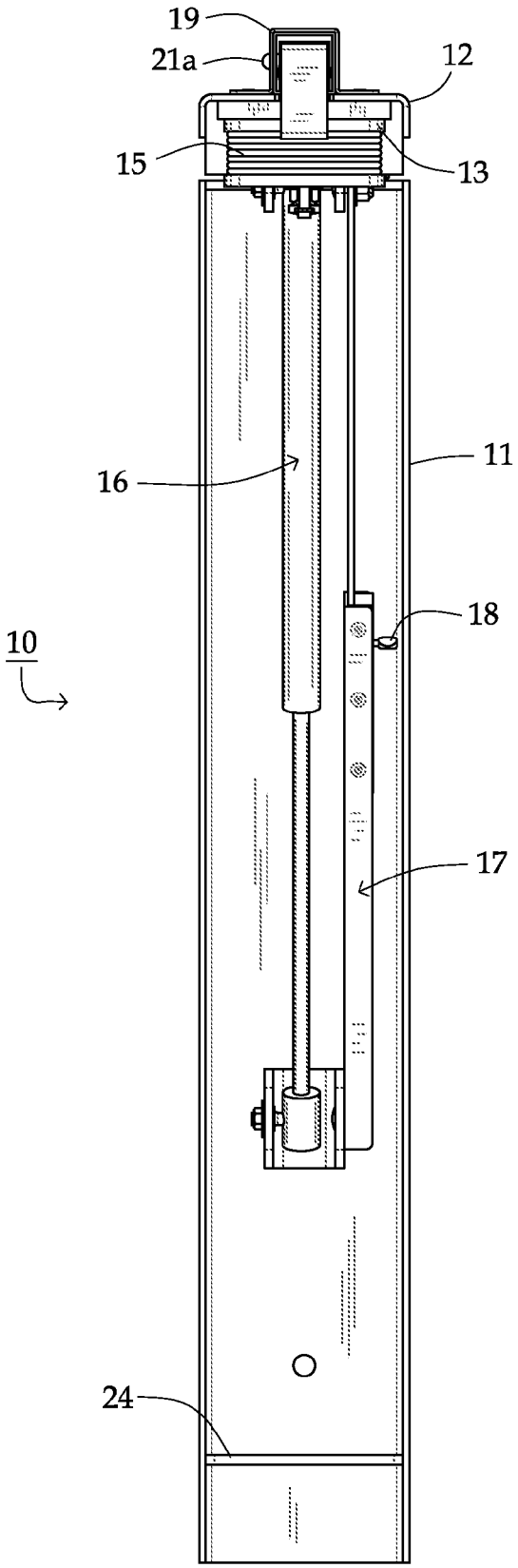
FIG. 3 depicts a front elevational view of the clothesline support of FIG. 2 but shown in a fully open posture.
Figure 5:
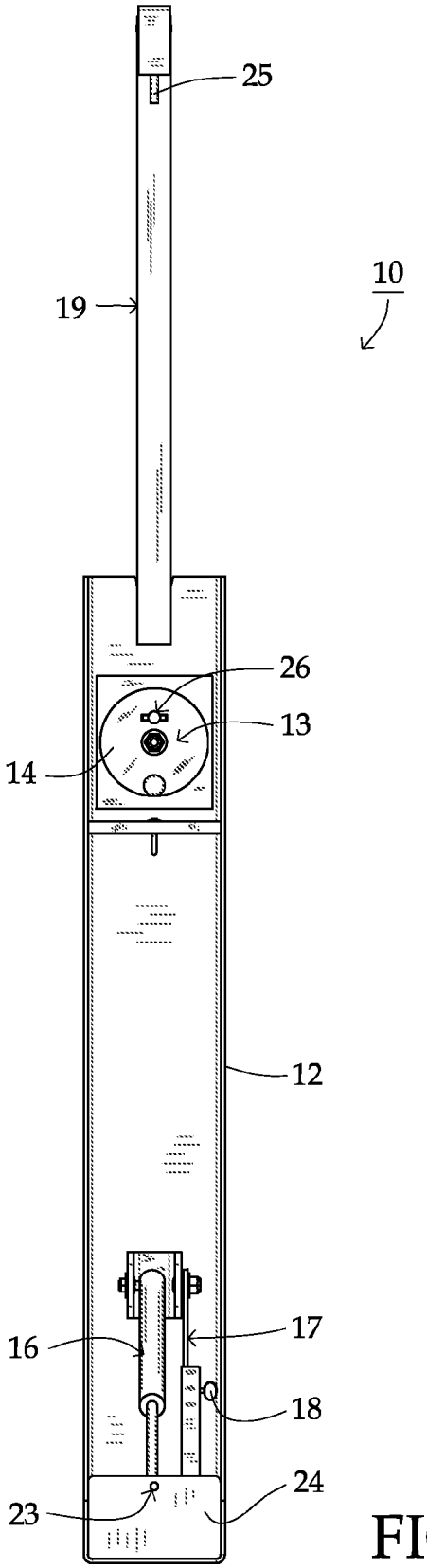
FIG. 5 illustrates a bottom plan view of the clothesline support with the arm opened and the telescoping arm extension fully extended.

When clothesline support 10 is in an open posture as seen in FIGS. 1, 3, and 5, the pressure of pneumatic cylinder 16 biases arm 12 to an open ninety degree (90°) posture by pivoting about hinge 29. Retractable brace 17 shown also in FIGS. 1, 3 and 5 allows the user to tighten thumb screw 18 to maintain arm 12 in a fully open (ninety degree) posture thereby maintaining the horizontal position of arm 12 relative to housing 11. Tightening of thumb screw 18 locks brace 17 in place insuring that the weight of (wet) items positioned on clothesline 15 would not overcome the "opening force" of pneumatic cylinder 16.

Figure 4:
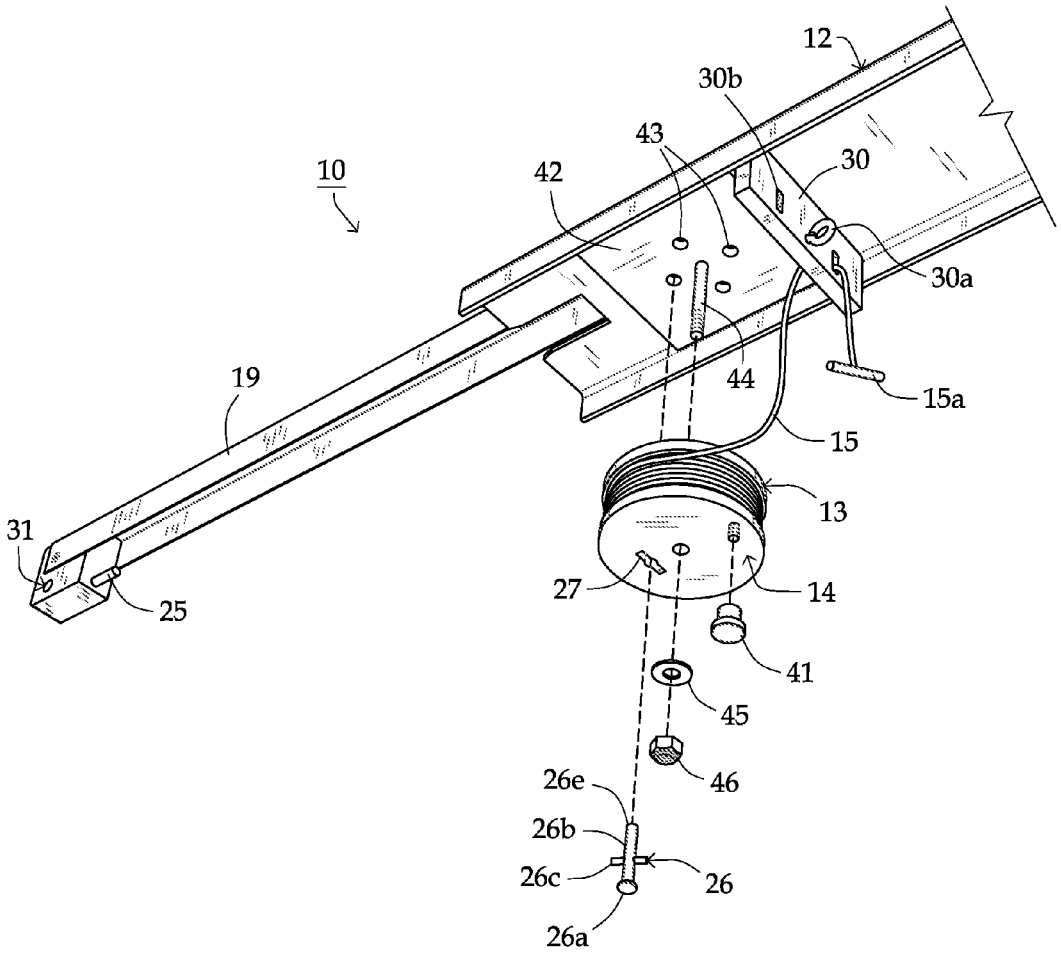
FIG. 4 demonstrates a perspective, partial view from beneath the opened, extended arm with the reel exploded therefrom.

As shown in FIG. 2 closed clothesline support 10 includes telescoping arm extension 19 which is affixed to the outside of pivotable arm 12 as also shown in FIG. 3. Telescoping arm extension 19 includes first section 20 and second section 21. As shown, first section 20 is affixed to the outer surface of pivotable arm 12 whereas second section 21 is smaller and slides within first section 20. Both sections 20 and 21 have a rectangular cross section and are preferably formed from square aluminum tubing. Housing 11, end member 24 and pivotable arm 12 are also formed from aluminum. As is conventional second section 21 includes depressible spring pin or button 21*a* for reception in one of a pair of opposing apertures 20*a* formed in the side of first section 20 as seen in FIG. 2 for either locking inner, second section 21 in a retracted position as seen in FIG. 2 with button 21*a* (FIG. 3) extending therethrough or in an extended position such as seen in FIGS. 4 and 5. Second section 21 of arm extension 19 includes line guide 31 and latch pin 25 affixed proximate the end thereof as shown in FIGS. 4 and 5. Line guide 31 is preferably formed from a polycarbonate plastic and attached to arm extension 19 such as by screws, adhesives or other suitable attachment means. Polycarbonate plastic is the preferred material for line guides 30 and 31 for its durable, light weight qualities and most importantly for the prevention of fraying of clothesline 15 during extended use, however other suitable materials could also be utilized. Latch pin 25 is received within aperture 23 of end member 24 and assists in maintaining housing 11 in a closed, latched position when clothesline support 10 is collapsed.

In the preferred method of use, a user (not shown) depresses button 21*a* for release of button 21*a* from aperture 20*a* proximate hinge 29 in first section 20 and then urges second section 21 of arm extension 19 outwardly or downwardly as shown by the dashed arrow in FIG. 2, whereby latch pin 25 is removed from aperture 23 to allow pivotable arm 12 to rotate (counterclockwise) outwardly about hinge 29. Once latch pin 25 is removed, the pressure within pneumatic cylinder 16 pushes arm 12 fully open (ninety degrees) and retractable brace 17 can then be locked using thumbscrew 18. As would be understood, heavy wet items hanging on line 15, could cause pneumatic cylinder 16 to collapse thus closing or partially closing arm 12. The additional locking of brace 17 prevents this inadvertent closing or collapsing of arm 12. Thereafter, second section 21 is fully extended whereby button 21*a* would enter aperture 20*a* proximate reel 13 to maintain full extension of second section 21.

Figure 6:
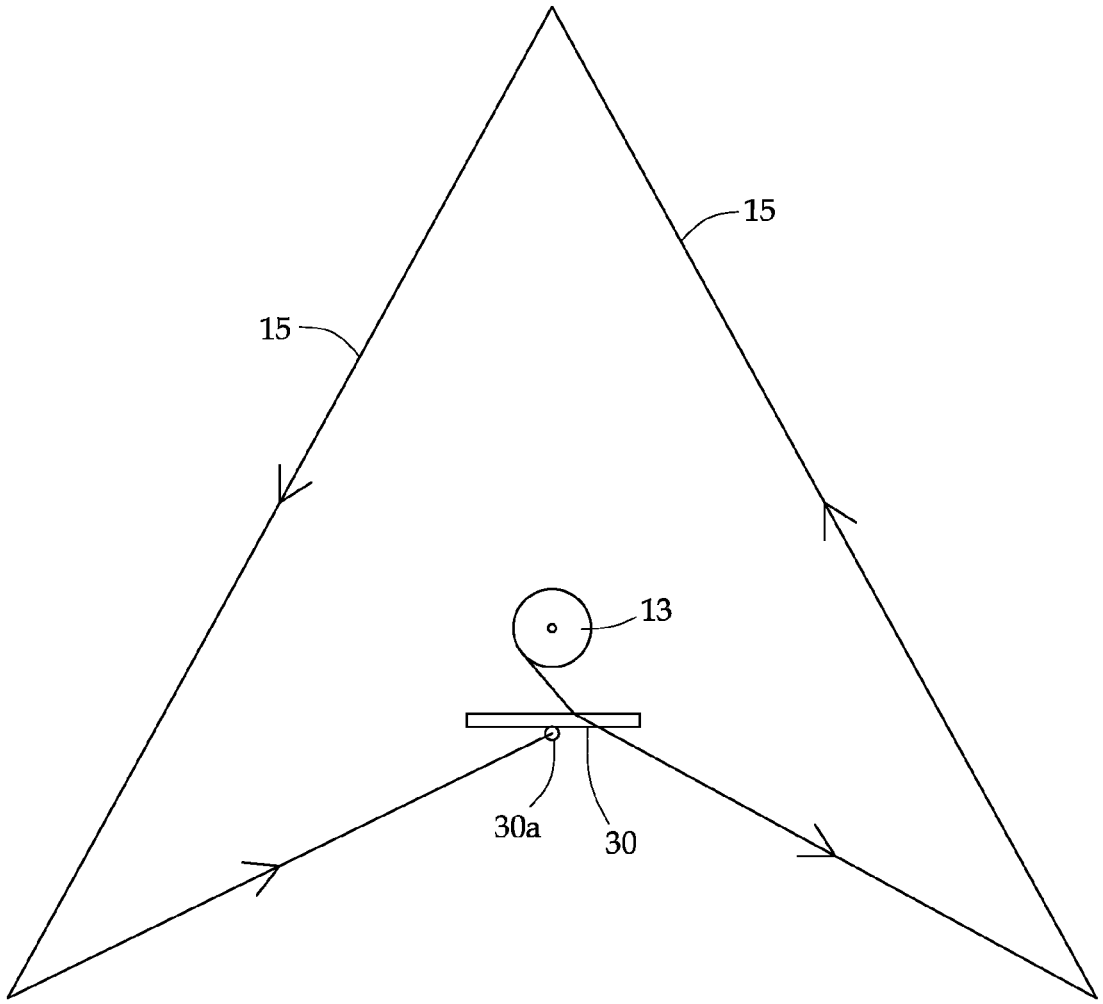
FIG. 6 features a schematic view of a typical triangular line configuration formed by the retractable clothesline.
Figure 6A:
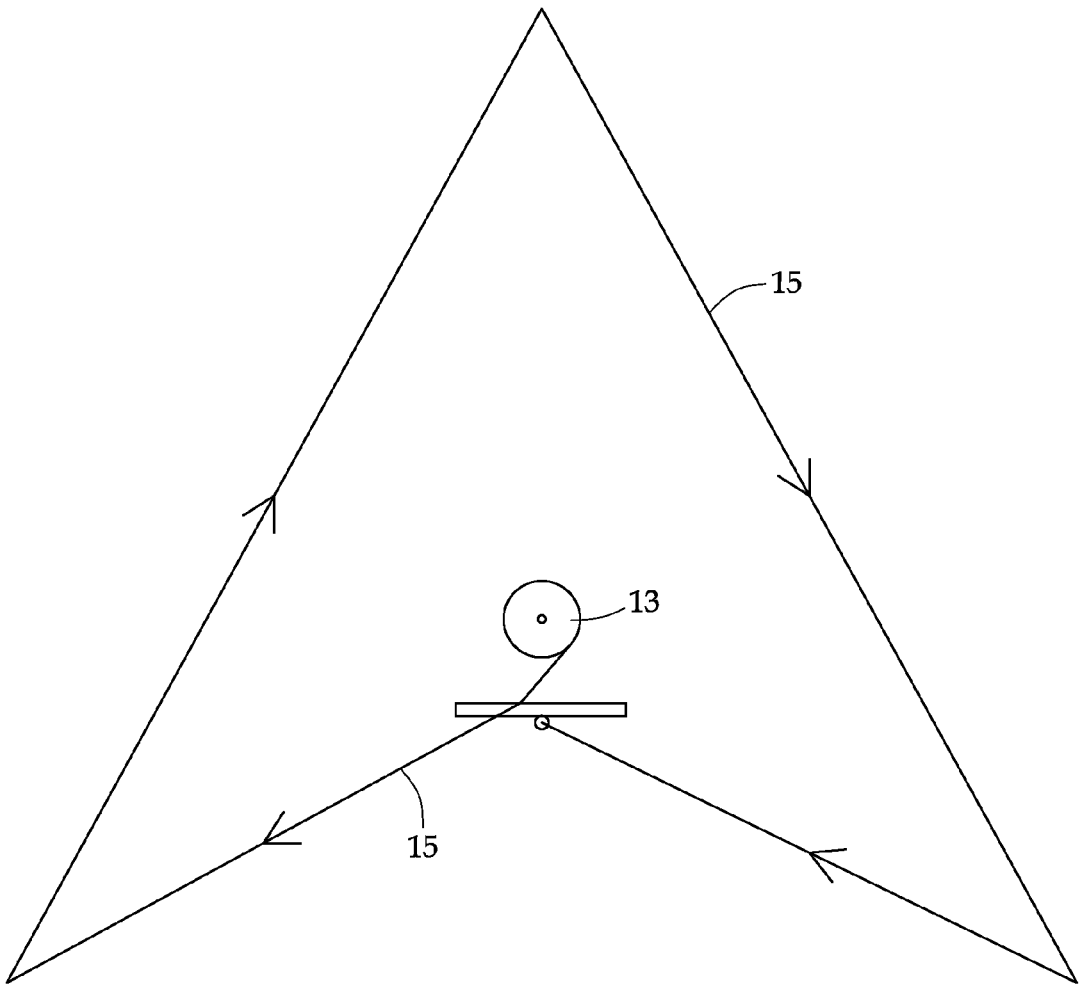
FIG. 6A shows another schematic line configuration from that seen in FIG. 6.

Once arm 12 is rotated to its desired position, knobbed end 26*a* of reel lock 26 is manually grasped and urged outwardly to easily remove cross member 26*c* from recess 27 in reel surface 14 as seen in FIG. 4. Knobbed end 26*a* is slightly rotated or turned and cross member 26*c* is then allowed to rest against surface 14 of line reel 13. With reel lock 26 so positioned, line 15 on reel 13 can be manually pulled and unwound to a desired length through line guide 30 (FIG. 4) and drawn into any of a number of configurations such as triangular as shown in FIGS. 6 and 6A or attached to a tree, post or other suitable member (not seen). Line 15 could also be attached such as shown in FIG. 1 and previously described whereby toggle 15*a* is engaged with line guide catch 30*a*. Once a sufficient amount of line 15 has been manually withdrawn from reel 13, reel lock 26 is again turned so cross member 26*c* enters recess 27 and end 26*e* is allowed to enter one of apertures 43 for locking reel 13 in place, preventing further unwinding of line 15. As would be understood, reel lock 26 is conventionally spring loaded to maintain its normal position within recess 27. Thereafter, line 15 so extended can be readily used for hanging wet clothes, RV hose parts or the like. Line 15 is preferably a conventional, strong nylon cord but could be a cotton, synthetic line, wire cable or other line as desired.

Once use of line 15 is complete and closure of clothesline support 10 is desired, the user would manually disengage reel lock 26 as previously described to provide slack in line 15 for removal of toggle 15*a* and line 15 from the various attachment points. The user then grasps and rotates reel winder 41 of reel 13 to easily retract line 15 onto reel 13. As seen in FIG. 4 with line 15 positioned through opening 30*b* in line guide 30, line 15 is self-guided for winding about reel 13 without worry of tangling and toggle 15*a* will cease the winding action once it abuts line guide 30. Thereafter, reel lock 26 is reengaged to lock reel 13 in place and prevent unwinding. Thumbscrew 18 is then loosened and a sufficient manual force used on arm 12 to overcome the pressure of pneumatic cylinder 16, pivoting arm 12 downwardly (clockwise) to close against housing 11. Button 21*a* is depressed for removal from aperture 20*a* and second section 21 can be manually pushed into first section 20 so button 21*a* enters opposing aperture 20*a* proximate hinge 29 and latch pin 25 engages aperture 23 in end member 24 to lock arm 12 against housing 11. Clothesline support 10 is thus closed in compact fashion on the side of RV 50 and is again ready for travel or use as needed. No tools are required for set up and use, and no additional storage space is required making clothesline support 10 a desirable addition to the traveling/camping experience.

The illustrations and examples provided herein are for explanatory purposes and are not intended to limit the scope of the appended claims.

I claim:

1. A collapsible drying device for drying articles comprising: a wall mountable housing adapted to be suspended from a wall, said housing includes a recess;

a pivotable arm pivotably attached to said housing to move said pivotable arm between an operational position wherein the pivotable arm extends generally orthogonal from said housing and a collapsed position wherein said pivotable arm is generally parallel to said housing for compact storage of the drying device;

a reel rotatably mounted on said pivotable arm;

a tether line, wherein said tether line wraps around said reel;

a telescopic arm extension attached to the pivotable arm, said telescopic arm has an aperture that is capable of receiving the tether line therethrough;

wherein, when said pivotable arm is in said operational position, said reel is free to rotate to unwind and extend said tether line to pass through the aperture of the telescopic arm and articles are capable of being stored on the tether line to dry said articles;

wherein, when said pivotable arm is moving from said operational position to said collapsed position, said tether line retracts around said reel and said pivot arm is pivoted into the collapsed position wherein said tether line and said reel are stored in said recess of said housing.

2. The collapsible drying device of claim 1 wherein a line guide is attached to said pivotable arm.

3. The collapsible drying device of claim 1 further comprising a reel lock, said reel lock attached to said reel.

4. The collapsible drying device of claim 1 further comprising a pneumatic cylinder, said pneumatic cylinder attached to said arm and to said housing.

5. The collapsible drying device of claim 1 further comprising a retractable brace, said retractable brace affixed to said arm and to said housing.

6. The collapsible drying device of claim 1 wherein said telescoping arm extension includes a latch pin.

7. The collapsible drying device of claim 6 wherein said housing defines an aperture, wherein said aperture of the housing is for receiving said latch pin.

8. The collapsible drying device of claim 1 wherein said telescoping arm extension comprises a first section and a second section, wherein said second section is slideably mounted in said first section.

9. The collapsible drying device of claim 1 further comprising a hinge, wherein said pivotable arm is attached to said said housing via said hinge.

10. The collapsible drying device of claim 8 wherein said first section defines a pair of openings, said second section comprises a spring pin, wherein said spring pin is selectively placed in one of said pair of openings in order to lock the second section in place.

11. The collapsible drying device of claim 5 wherein said retractable brace comprises a thumb screw, wherein said thumb screw is capable of limiting the adjustment of said retractable brace in order to lock the retractable brace in place.

12. A method of utilizing a collapsible drying device comprising the steps of:

a) providing a wall mountable housing adapted to be suspended from a wall, said housing includes a recess;

providing a pivotable arm pivotably attached to said housing to move said, pivotable arm between an operational position wherein the pivotable arm extends generally orthogonal from said housing and a collapsed position wherein said pivotable arm is generally parallel to said housing for compact storage of the drying device;

providing a reel, said reel being rotatably mounted on said pivotable arm;

providing a tether line, wherein said tether line wraps around said reel;

providing a telescopic arm extension, said telescopic arm extension being attached to the pivotable arm, said telescopic arm has an aperture that is capable of receiving the tether line therethrough;

wherein, when said pivotable arm is in said operational position, said reel is free to rotate to unwind and extend said tether line to pass through the aperture of the telescopic arm and articles are capable of being stored on the tether line to dry said articles;

wherein, when said pivotable arm is moving from said operational position to said collapsed position, said tether line retracts around said reel and said pivot arm is pivoted into the collapsed position wherein said tether line and said reel are stored in said recess of said housing b) pivoting the pivotable arm away from the housing to expose the reel;

c) unwinding the tether line from the reel; and d) affixing the unwound tether line to a support structure.

13. The method of claim 12 comprising the step of selectively locking the reel.

14. The method of claim 12 wherein pivoting the pivotable arm comprises the step of pivoting the arm generally ninety degrees from the housing.

15. The method of claim 12 wherein unwinding the tether line comprises the step of manually pulling the tether line from the reel.

16. The method of claim 12 wherein affixing the unwound tether line comprises the step of locking the reel with the tether line extended.

17. The method of claim 12 further comprising the step of retracting the tether line on the reel.

18. The method of claim 17 further comprising the step of pivoting the pivotable arm into contact against the housing.

* * * * *